US008314664B2

(12) United States Patent
Bertram et al.

(10) Patent No.: US 8,314,664 B2
(45) Date of Patent: Nov. 20, 2012

(54) MICROSTRIP TECHNOLOGY HYPERFREQUENCY SIGNAL COUPLER

(75) Inventors: Pierre Bertram, Jallais (FR); Hugues Augereau, Cholet (FR); Georges Peyresoubes, Cholet (FR)

(73) Assignee: Thales, Neuilly-sur-Siene (FR)

( * ) Notice: Subject to any disclaimer, the term of this patent is extended or adjusted under 35 U.S.C. 154(b) by 282 days.

(21) Appl. No.: 12/599,598

(22) PCT Filed: Apr. 30, 2008

(86) PCT No.: PCT/EP2008/055327

§ 371 (c)(1),
(2), (4) Date: Dec. 17, 2009

(87) PCT Pub. No.: WO2008/141902

PCT Pub. Date: Nov. 27, 2008

(65) Prior Publication Data

US 2010/0194490 A1 Aug. 5, 2010

(30) Foreign Application Priority Data

May 11, 2007 (FR) ..... 07 03381

(51) Int. Cl.
*H01P 5/18* (2006.01)
*H01P 3/08* (2006.01)

(52) U.S. Cl. ..... 333/116; 333/109

(58) Field of Classification Search ..... 333/109, 333/110, 111, 112, 115, 116, 161
See application file for complete search history.

(56) References Cited

U.S. PATENT DOCUMENTS 4,677,399 A * 6/1987 Le Dain et al. ..... 333/116
4,799,032 A * 1/1989 Sugawara ..... 333/116
4,999,593 A * 3/1991 Anderson ..... 333/112
5,111,165 A * 5/1992 Oldfield ..... 333/116
5,666,090 A * 9/1997 Tsuruoka ..... 333/116
6,150,898 A 11/2000 Kushitani et al.
7,132,906 B2 * 11/2006 Podell ..... 333/109
2002/0113667 A1 8/2002 Tahara et al.
2003/0011442 A1 1/2003 Ashoka
2004/0263281 A1 12/2004 Podell
2007/0001780 A1 1/2007 Nichols

FOREIGN PATENT DOCUMENTS

EP 1 215 749 A1 6/2002

OTHER PUBLICATIONS

Chul-Soo Kim, et al., "A Design of Single and Multi-Section Microstrip Directional Coupler with a High Directivity", Microwave Symposium Digest, IEEE MTT-S International, Jun. 6-11, 2004, pp. 1895-1898, vol. 3, IEEE, Piscataway, NJ, USA.

* cited by examiner

*Primary Examiner* — Dean O Takaoka
(74) *Attorney, Agent, or Firm* — Baker & Hostetler LLP

(57) ABSTRACT

The present invention relates to a power coupler for hyperfrequency signals. The single-section coupler with microstrip lines comprises a dielectric substrate, a main line and a secondary line comprising a coupling section, the lines being deposited on the substrate, the main line being substantially rectilinear and uniform over its entire length, the coupling section comprising a protuberance at each of its ends, the protuberances being interlinked by a portion of conductive line of which the section, the shape and the disposition are adapted to minimize the coupling between said portion and the main line relative to the coupling made between the protuberances and the main line. The invention applies notably to the measurement of the power of a signal passing through a transmission line.

5 Claims, 2 Drawing Sheets

MICROSTRIP TECHNOLOGY HYPERFREQUENCY SIGNAL COUPLER

CROSS-REFERENCE TO RELATED APPLICATIONS

This application is a national stage of International Application No. PCT/EP2008/055327, filed Apr. 30, 2008, which claims priority to foreign French Application No. FR 07 03381, filed May 11, 2007, the disclosure of each application is hereby incorporated by reference in their entirety.

FIELD OF THE INVENTION

The present invention relates to a microstrip technology hyperfrequency signal coupler. It applies notably to the measurement of the power of a signal passing through a transmission line. In the telecommunications field, such couplers are, for example, integrated in amplifiers to measure the power of a signal delivered to an antenna.

BACKGROUND OF THE INVENTION

A proximity coupler, hereinafter simply referred to as "coupler", comprises a main transmission line making it possible to route a hyperfrequency signal, and a secondary line of which a section is placed in proximity to the main line. By electromagnetic radiation, the secondary line is thus coupled to the main line. The microstrip technology signal couplers are very widely used because they are inexpensive to make and easy to integrate. However, this technology limits their performance. In particular, a satisfactory coupling directivity, that is to say a good separation of the incoming and outgoing power measurements in the coupler, is difficult to obtain. This difficulty is mainly due to the asymmetries of the even and odd transmission modes that appear with the use of this technology. Finally, in general, the insertion losses and the signal reflections—which are reflected in a non-zero standing wave ratio—are parameters to be taken into account when designing a coupler.

By comparison, the coaxial technology or triplate technology couplers provide for high level performance thanks to the shielding surrounding the propagation lines. However, these technologies increase the bulk and, above all, the fabrication cost of a coupler.

In order to improve the performance level of the microstrip technology couplers toward that of the coaxial or triplate technology couplers, a number of adaptations have already been proposed. Thus, it is known to add one or more capacitive components linking the main transmission line with the coupled secondary line. However, this solution presents a number of drawbacks. On the one hand, components that theoretically have the same capacitive values in reality exhibit capacitance values that are scattered around a mean value. It is therefore difficult to fabricate couplers in series that offer reproducible performance. On the other hand, the implanting of capacitive elements increases the production complexity of the coupler, consequently increasing its fabrication cost. Another known solution is to design transmission lines in singular shapes, in order to optimize the coupling between the main transmission line and the coupled line. However, singularities introduced in the main transmission line often cause the transmission of the signal to be disturbed and therefore the insertion losses to be increased.

SUMMARY OF THE INVENTION

One aim of the invention is to increase the coupling directivity without affecting the fabrication reproducibility of the coupler, while keeping the insertion losses at low levels, for a fabrication cost that is not very high. To this end, the subject of the invention is a single-section coupler with microstrip lines comprising a dielectric substrate, a main line and a secondary line comprising a coupling section, the lines being deposited on the substrate, characterized in that the main line is substantially rectilinear and uniform over its entire length, and in that the coupling section comprises a protuberance at each of its ends, the protuberances being interlinked by a portion of conductive line of which the section, the shape and the disposition are adapted to minimize the coupling between said portion and the main line relative to the coupling made between the protuberances and the main line, the coupling being mostly made between each of the protuberances and the main line.

According to one embodiment, the coupler according to the invention is asymmetrical.

A resistive balancing element can be connected between one end of the coupling section and the electrical ground. This resistive element makes it possible to optimize the directivity characteristic of the coupler and, to this end, can have capacitive or resistive characteristics that make it possible to improve performance. This resistive element does not replace the terminal loads conventionally connected to each of the access ports of the coupler.

According to one embodiment, the coupler according to the invention comprises at least one first resistive balancing element connected to the first protuberance, at least one second resistive element being connected to the second protuberance, the first and second resistive elements having different impedance values.

According to one embodiment, the distance D1 between the first protuberance and the main line, on the one hand, and the distance D2 between the second protuberance and the main line, on the other hand, are unequal.

According to one embodiment, the dimensions of the first protuberance, on the one hand, and the dimensions of the second protuberance, on the other hand, are different.

Another subject of the invention is a power amplifier comprising a coupler as claimed as described above.

Other features and benefits will become apparent from reading the following detailed description given as a nonlimiting example, in light of the appended drawings which represent:

DETAILED DESCRIPTION OF THE INVENTION

Figure 1:
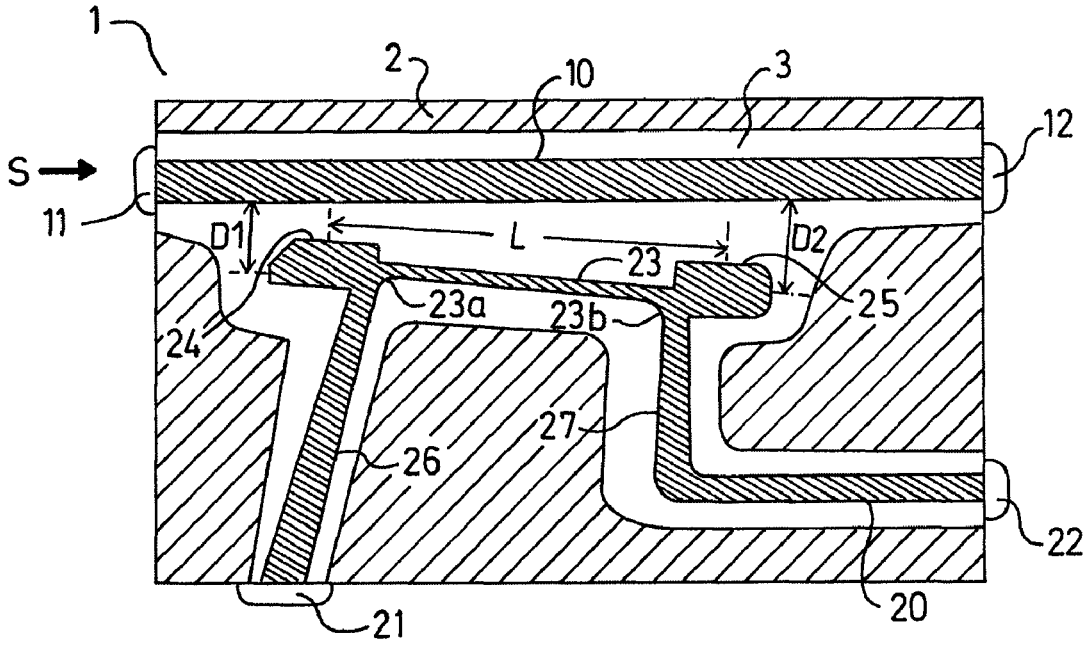
FIG. 1, a plan view of a first embodiment of the coupler according to the invention, FIG. 2, a plan view of a second embodiment of the coupler according to the invention, FIG. 3, a variant embodiment of the coupler according to the invention, FIG. 4, an example of use of a coupler according to the invention in a power amplifier.

FIG. 1 shows a plan view of a first embodiment of the coupler according to the invention. A coupler 1 comprises a metal plate 2, placed on the underside of the coupler and acting as electrical ground. The metal plate 2 has a layer of dielectric substrate 3 applied to it, with microstrips of conductive material deposited thereupon. A first conductive microstrip forms a main transmission line 10 routing a signal 10 from which a fraction of the power is to be taken. The main line 10 has an access port 11, 12 at each of its ends. The first access port 11 receives the signal S, of power P, incoming into the coupler 1, whereas the second access port 12 is linked to a load, not represented in the figure, for example an antenna. Depending on the impedance of the load, a more or less significant power $P_{ref}$ of the signal S is reflected into the main line 10. The coupler 1 also comprises a secondary line 20 comprising, at each of its ends, a third and a fourth access port 21, 22.

The secondary line 20 comprises a central portion of conductive line 23 that is relatively thin, conductive protuberances 24, 25, and conductive microstrips 26, 27 connecting to the access ports 21, 22. The whole consisting of the protuberances 24, 25 and the central portion 23 forms a coupling section with the main line 10. The coupling section is produced so that the third access port 21 receives a fraction P' of the power P of the signal S and the fourth access port 22 receives a fraction $P_{ref}'$ of the power $P_{ref}$ reflected into the main line 10.

The main line 10 is substantially rectilinear and its width, selected according to the desired characteristic impedance, remains virtually constant over its entire length. This design simplicity makes it possible to retain a characteristic line impedance close to the terminal impedances at the access ports 11, 12, so reducing the standing wave ratio present in the line 10.

Moreover, in the example, a metallized layer, in contact with the metal plate 2, is applied to the top of the coupler 1 and around the lines 10, 20 to perfect the electromagnetic shielding of the coupler.

The first conductive protuberance 24 is placed at a first end 23*a* of the central portion 23 and the second protuberance 25 is placed at its opposite end 23*b*. The protuberances 24, 25 are, in the example, quasi-rectangular in shape, but can have different shapes and dimensions. The barycenters of the protuberances 24, 25 are separated by a distance L of the order of a quarter of the median value of the wavelengths corresponding to the operating band of the coupler 1. The distance D1 separating the first protuberance 24 from the main line 10 can be different from the distance D2 separating the second protuberance 25 from the main line 10, but both protuberances 24, 25 must be sufficiently close to the main line 10 for an electromagnetic coupling to exist with the secondary line 20. Similarly, the shapes (length and/or width) of each of the protuberances can be different. In practice, most of the coupling between the two lines 10, 20 is made via the conductive protuberances 24, 25. The distances D1 and D2 separating the protuberances 24, 25 from the main line 10 and the dimensions of the protuberances 24, 25 are selected notably according to the dielectric characteristics (notably the permittivity) of the substrate 3, the thickness of the substrate layer and the desired coupling level, that is to say, the power ratio P/P'.

In order to optimize the performance of the coupler according to the invention, the width, the shape and the placement of the central portion 23 linking the two protuberances 24, 25 are selected so that said central portion 23 is not involved or is almost uninvolved in the coupling between the main line 10 and the secondary line 20. Thus, in the example of FIG. 1, the width of the central portion 23 is selected to be thin (in the example, said portion 23 is much thinner than the main line 10) in order to minimize the interaction between said central portion 23 and the main line 10. The central portion 23 is moreover neither necessarily parallel to the main line 10, nor even rectilinear, thus making its length adjustable.

Figure 2:
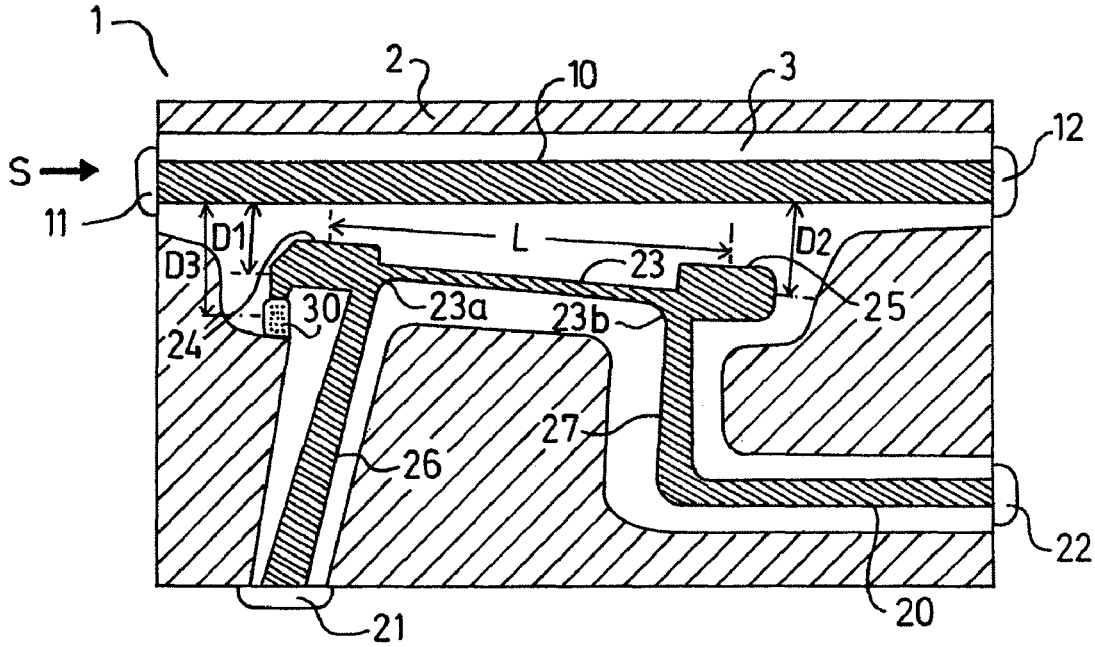

For example, in another embodiment illustrated in FIG. 2, this central portion 23 forms a U between the two protuberances 24, 25, in order to guarantee a distancing of said portion 23 from the main line 10 making it possible to minimize the interaction with said main line 10. In practice, the bottom 29 of the duly formed U is at a distance selected so that, when a signal is transmitted, in the main line 10, there is virtually no coupling between the central portion 23 and the main line 10. Moreover, when the distance between the central portion 23 and the main line 10 is increased, the section of the central portion 23 can also be increased.

The connecting microstrips 26, 27 make it possible to transmit the powers P' and $P_{ref}'$ taken at the access ports 21, 22 of the coupler 1. The first connecting microstrip 26 links the third access port 21 to the end of the central portion 23 closest to the first access port 11, and the second connecting microstrip 27 links the fourth access port 22 to the end of the central portion 23 closest to the second access port 12. These connecting microstrips 26, 27 are, in the example, connected at the ends 23*a*, 23*b* of the central portion 23. They can, furthermore, form any angle with the central portion 23, so offering enhanced possibilities of integration in complex circuits.

Figure 3:
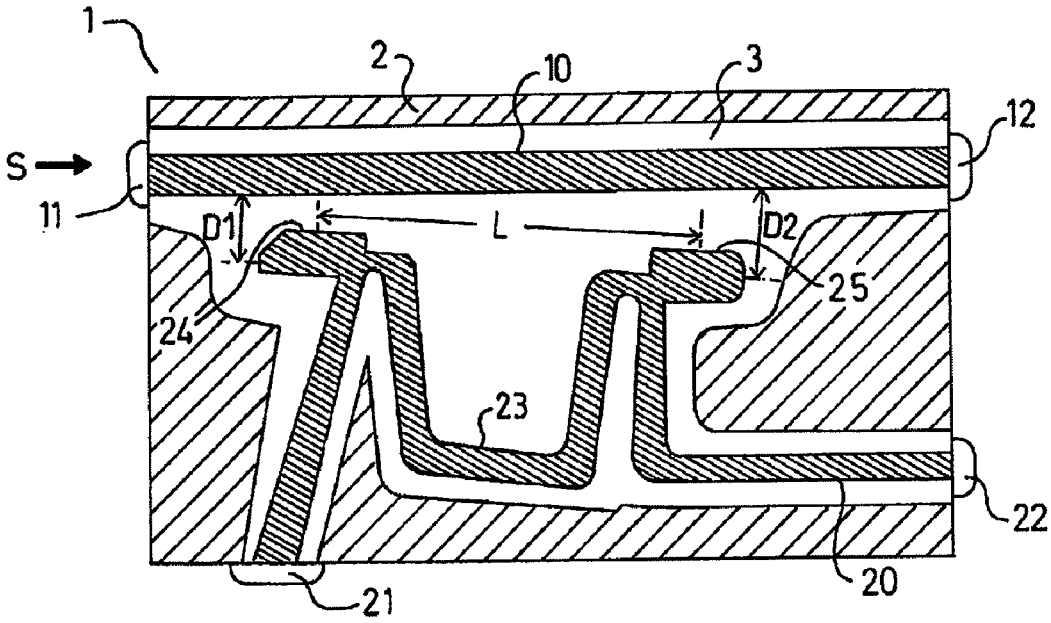

According to a variant embodiment shown in FIG. 3, a resistive balancing element 30 can be connected to one of the protuberances 24, 25. In the example, the resistive element 30 is connected to the protuberance 24 closest to the first access port 11. This asymmetry of the coupler 1 makes it possible to compensate for the asymmetries of the even and odd transmission modes that appear with the use of the microstrip technology. Optimizing the value of this lateral resistive element 30 makes it possible to improve the performance of the coupler directivity-wise. The resistive element 30 is placed at a distance D3 from the main line 10 so as not to disturb the propagation of the signal S and is linked to the electrical ground, formed in the example by the metal ground 2. This resistive element 30 can, for example, consist of a number of sub-elements placed in series and/or in parallel (not shown in the interests of simplification) and having certain inductive or capacitive properties, the operation of which makes it possible to improve the directivity of the coupler 1. Connecting this resistive element 30 to a protuberance 24, 25 (that is to say, a wide metallized land) makes it possible to avoid having its precise positioning affect the performance of the coupler 1, so facilitating the reproducibility of the performance in a series coupler fabrication context. According to another embodiment, the asymmetry of the coupler can, for example, be obtained by integrating two resistive elements of different characteristics into the coupler, a first resistive element being connected to the first protuberance 24, a second resistive element being connected to the second protuberance 25. Finally, since the resistive element 30 has an effect on the impedance of the secondary line 20, the microstrips 26 and 27 can, in order to improve the adaptation of the third and fourth ports 21 and 22 of the coupler, comprise impedance transforming elements.

Figure 4:
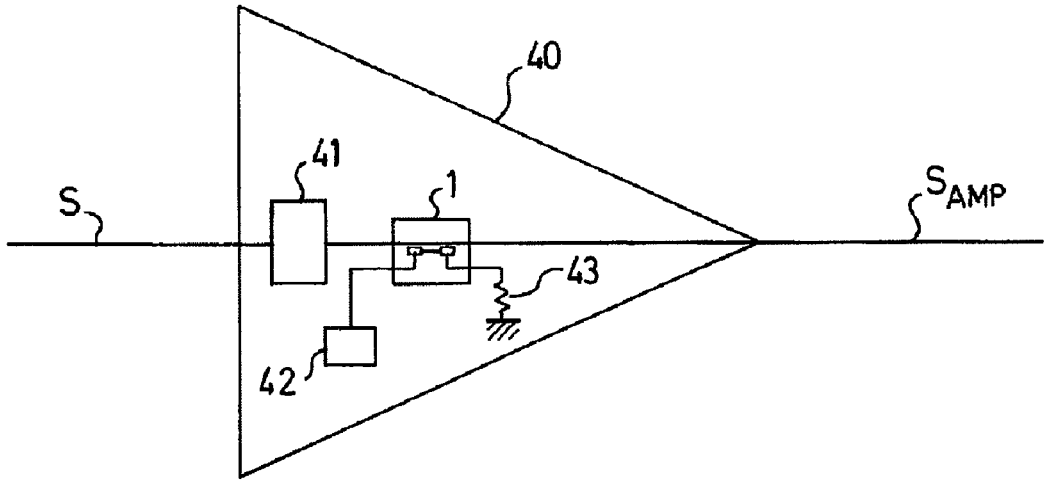

FIG. 4 shows an example of use of a coupler according to the invention in a power amplifier. An amplifier 40 receives a signal S and delivers an amplified signal $S_{AMP}$. It comprises an amplification cell 41, a coupler 1 according to the invention, a measurement module 42 and a resistive load 43. The measurement module 42 is linked to the third access port 21 of the coupler 1, and the resistive load 43 is linked to its fourth access port 22. The amplification cell 41 receives the signal S and supplies a first amplified signal $S_{INT}$ to the first access port 11 of the coupler 1. The coupler 1 takes a fraction of the power of the signal $S_{INT}$, a power fraction that it transmits to the measurement module 42 via its third access port 21. The coupler 1 also produces a signal $S_{AMP}$ obtained from its second port 12, then directed to the output of the amplifier 40. The association of the coupler 1 with the measurement module 42 therefore makes it possible to know the power of the signal $S_{AMP}$ delivered at the output of the amplifier 40.

One benefit of the coupler according to the invention is the simplicity with which it can be produced, allowing it to be easily and inexpensively integrated in equipment while benefitting from good performance with excellent reproducibility.

The invention claimed is:

1. An asymmetrical single-section coupler with microstrip lines comprising a dielectric substrate, a main line and a secondary line comprising a coupling section, the lines being deposited on the substrate, wherein the main line is substantially rectilinear and uniform over its entire length, wherein the coupling section comprises a coupling protuberance at each of its ends, the protuberances being interlinked by a portion of conductive line of which the section, the shape and the disposition are adapted to minimize the coupling between said portion and the main line relative to the coupling made between the protuberances and the main line, and wherein at least one first resistive balancing element is connected to the first protuberance and at least one second resistive element is connected to the second protuberance, the first and second resistive elements having different impedance values in order to optimize the directivity of the single-section coupler.

2. The single-section coupler as claimed in claim 1, wherein a resistive balancing element is connected between one end of the coupling section and the electrical ground in order to optimize the directivity of the single-section coupler.

3. The single-section coupler as claimed in claim 1, wherein the distance D1 between the first protuberance and the main line, on the one hand, and the distance D2 between the second protuberance and the main line, on the other hand, are unequal.

4. The single-section coupler as claimed in claim 1, wherein the dimensions of the first protuberance, on the one hand, and the dimensions of the second protuberance, on the other hand, are different.

5. A power amplifier comprising at least one single-section coupler as claimed in claim 1.

* * * * *